US007055272B2

(12) United States Patent
Tollis

(10) Patent No.: US 7,055,272 B2
(45) Date of Patent: Jun. 6, 2006

(54) CONSTRUCTION SITE DOCUMENT STORAGE APPARATUS

(76) Inventor: David R. Tollis, 6521 209th St. East, Bradenton, FL (US) 34211

( * ) Notice: Subject to any disclaimer, the term of this patent is extended or adjusted under 35 U.S.C. 154(b) by 71 days.

(21) Appl. No.: 10/856,556

(22) Filed: May 28, 2004

(65) Prior Publication Data

US 2005/0262744 A1 Dec. 1, 2005

(51) Int. Cl.
*G09F 7/00* (2006.01)

(52) U.S. Cl. ..... 40/611.07; 40/607.01; 40/611.01

(58) Field of Classification Search ..... 40/312, 40/313, 606.05, 611.01, 765, 722; 232/17; 220/229

See application file for complete search history.

(56) References Cited

U.S. PATENT DOCUMENTS 1,502,137 A * 7/1924 De Foreest et al. ..... 40/655
2,306,613 A * 12/1942 Chesley ..... 206/248
2,423,532 A * 7/1947 Travis ..... 232/17
3,037,617 A * 6/1962 Collin ..... 206/279
4,303,154 A * 12/1981 Hicks ..... 206/86
4,821,440 A 4/1989 Dunn
5,529,173 A 6/1996 Salacuse
5,623,778 A 4/1997 Dunn
5,664,851 A 9/1997 Dunn
5,800,027 A 9/1998 Dunn
6,012,786 A 1/2000 Dunn
6,070,744 A 6/2000 Levinson
D430,216 S 8/2000 Dunn
6,618,974 B1 9/2003 Szalay
6,793,070 B1 * 9/2004 Dye ..... 206/45.24

* cited by examiner

*Primary Examiner*—Cassandra Davis
(74) *Attorney, Agent, or Firm*—Charles J. Prescott

(57) ABSTRACT

A weather resistant construction site document storage apparatus comprising an elongated outer enclosure having a front panel, a back panel, two spaced side panels and a top panel, all of which are formed into a single weather-sealed unit having an open bottom thereof. An elongated inner document frame has a top panel, two spaced side panels, and a back panel, all of which are formed into a single unit. A document retaining panel is connected to, and upwardly extends from, the bottom panel to define a trough, a remainder of a front surface of the inner frame being substantially open to place documents into the trough. The outer enclosure is sized for close upward and downward sliding engagement over the inner frame to cover the open front surface and to weather protect documents placed into the trough. A slidable connector positioned between the side panels of the outer enclosure and the inner frame allow the outer enclosure to be slidably lifted upwardly for document placement and removal from the trough.

10 Claims, 8 Drawing Sheets

FIG 9
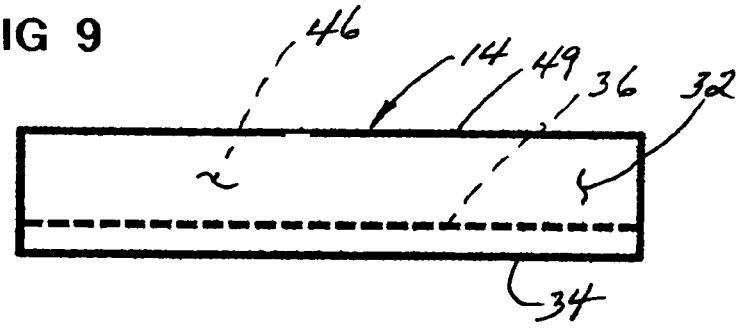
FIG 10
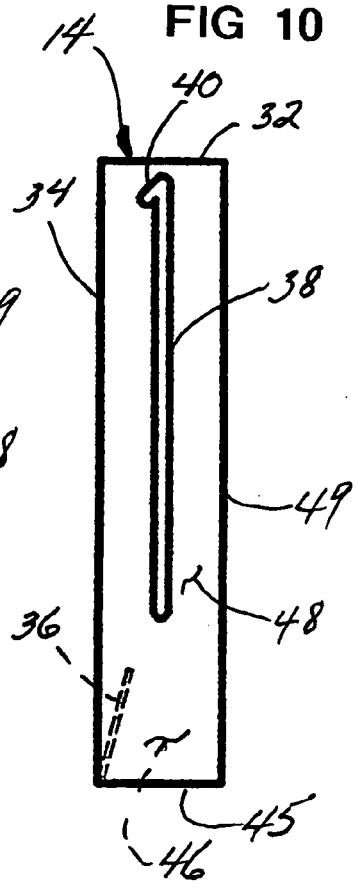
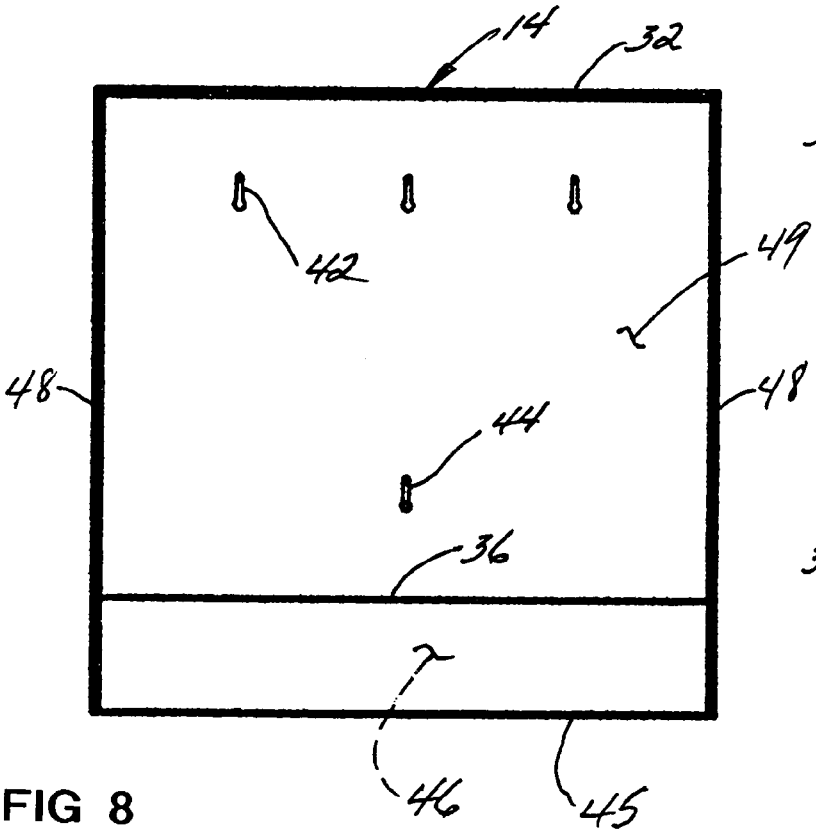
FIG 8

CONSTRUCTION SITE DOCUMENT STORAGE APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to display apparatus and more particularly to a weather resistant construction site documentation storage apparatus which is affixed to a support structure at a building or home construction site.

2. Description of Related Art

Documents related to a home or building construction site such as building permits and drawings must be kept in a weather resistant storage apparatus at each such construction site. Construction site storage apparatus are typically fastened to a tree or to an upright wooden board member which is driven into the ground. Inspectors and contractors routinely place documents into these storage apparatus and remove them therefrom as required during construction. An inspector may visit a construction site numerous times and require access to the building construction drawings while the public at large is placed on notice as to the details of the construction as set forth in the building permit which is also stored within the document storage apparatus.

Several environmental restrictions or requirements are placed upon such construction site document storage apparatus, namely the wear and tear they must undergo at a construction site and their weather-tight design structure required to insure that the documents placed therewithin are not ruined with rainwater intrusion or blown from the storage apparatus should the openable feature thereof become disengaged during high wind conditions.

Gary Dunn has brought his inventiveness to bear as set forth in numerous patents issued to him. One such disclosure in U.S. Pat. No. 4,821,440 teaches such a construction site document disclosure apparatus having a back frame having a U-shaped curl at each outer edge of its top and bottom sides and a four-sided hinged cover which engages in flush fashion therewith to prevent water access into the interior of the apparatus. In U.S. Pat. No. 5,623,778, Dunn teaches a weatherized posting board assembly having a back frame and a front cover of unitary construction for the posting and removal of documents to be posted therein. In U.S. Pat. No. 5,664,851, Dunn there teaches another document display case for displaying construction permits and the like, the weather resistant case having a base member and a door hinged thereto and also providing a tack board mounted to the rear wall of the base member for supporting displayed documents. A transparent window in the door permits viewing of the documents directly.

Dunn further teaches in U.S. Pat. No. 5,800,027 a brochure display case for displaying and dispensing promotional literature, business cards and the like at unattended sites. In U.S. Pat. No. 6,012,786, Dunn has disclosed still another construction site display and storage case which is weather resistant and ventilated. A unique notch and slot structure is adapted for attachment of the device to either an upright or a horizontal board support member. The design features of a permit box are also taught by Dunn in U.S. Design 430,216.

Other related prior art known to applicant are taught in U.S. Pat. No. 5,529,173 by Salacuse teaching a convertible container and frame having two panels hingedly connected together and, when open, providing a double length framed area. Levinson, in U.S. Pat. No. 6,070,744 teaches another display unit for attachment to a supporting surface and including downwardly extending document display holder panels pivotally attached to a support member. In U.S. Pat. No. 6,618,974, Szalay teaches a message display apparatus including a frame with spaced side rails which slidably receive a pair of covers, one of which is visibly clear for viewing documents and protecting them from weather conditions.

The present invention provides a weather resistant construction site document storage apparatus having uniquely configured inner document frame and outer enclosure aspects which slidably engage vertically one to another to provide access for placement and removal of documents when the outer enclosure is in a temporarily fixed upward position. The inner document frame is attachable to either a tree or other timber support member or to a uniquely configured elongated T-shaped support member which is securely engageable into the ground. A separate front document enclosure attachable to the front panel of the outer enclosure is also provided and is preferred.

BRIEF SUMMARY OF THE INVENTION

This invention is directed to a weather resistant construction site document storage apparatus comprising an elongated outer enclosure having a front panel, a back panel, two spaced side panels and a top panel, all of which are formed into a single weather-sealed unit having an open bottom thereof. An elongated inner document frame has a top panel, two spaced side panels, and a back panel, all of which are formed into a single unit. A document retaining panel is connected to, and upwardly extends from, the bottom panel to define a trough, a remainder of a front surface of the inner frame being substantially open to place documents into the trough. The outer enclosure is sized for close upward and downward sliding engagement over the inner frame to cover the open front surface and to weather protect documents placed into the trough. A slidable connector positioned between the side panels of the outer enclosure and the inner frame allow the outer enclosure to be slidably lifted upwardly for document placement and removal from the trough.

It is an object of this invention to provide a weather tight construction site permit and document storage apparatus which is attachable to an upright support member at a construction site.

Another object of this invention is to provide a simply constructed and durable weather resistant construction site document storage apparatus which is easily attachable either to a tree, an upright board having been anchored into the ground or to a uniquely configured support member which is also anchorable into the ground.

Still another object of this invention is to provide a multiple compartment weather resistant construction site document storage apparatus providing for a larger weather tight storage area for construction permits and other documents and a smaller weather tight area of storage for construction blueprints and site drawings permits and other smaller documents.

A yet further object of this invention is to provide a multiple compartment weather resistant construction site document storage apparatus that may be mounted and moved without the need for tools.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 8 is a front elevation view of the inner document frame of FIG. 6.

FIG. 9 is a top plan view of FIG. 8.

FIG. 10 is a side elevation view of FIG. 8.

DETAILED DESCRIPTION OF THE INVENTION

Figure 1:
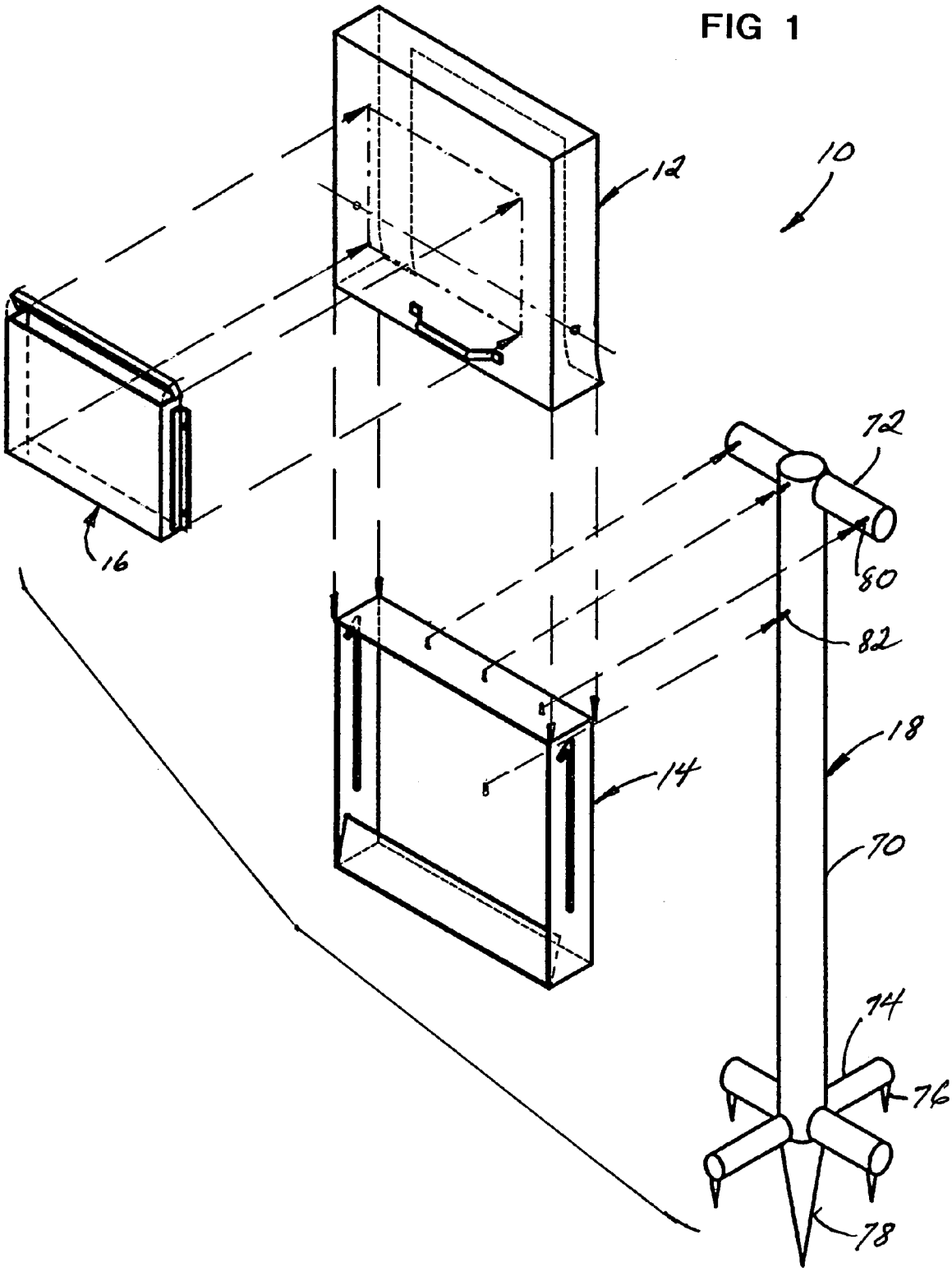
FIG. 1 is an exploded perspective view of the preferred embodiment of the invention.
Figure 2:
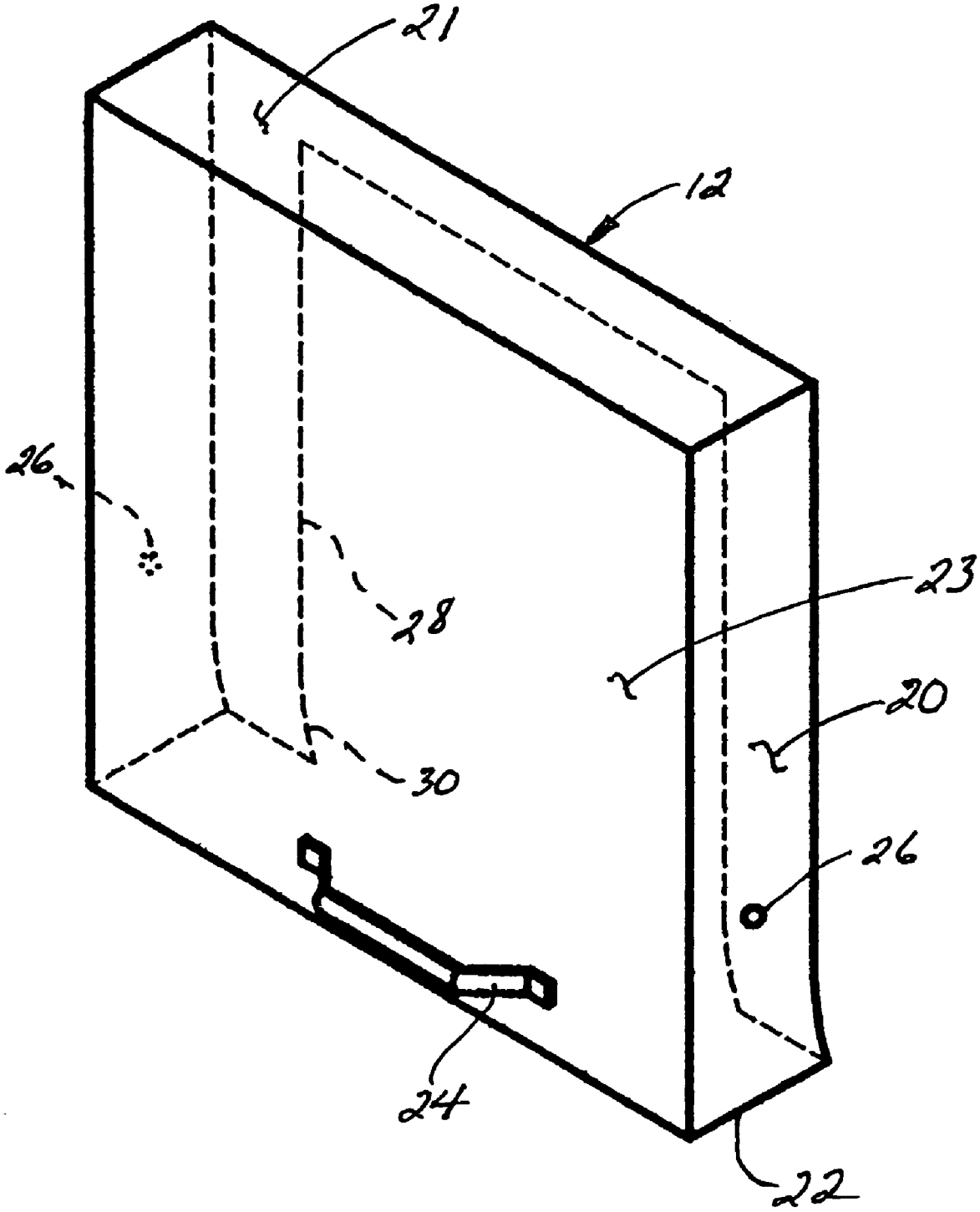
FIG. 2 is a perspective view of the outer enclosure of FIG. 1.
Figure 4:
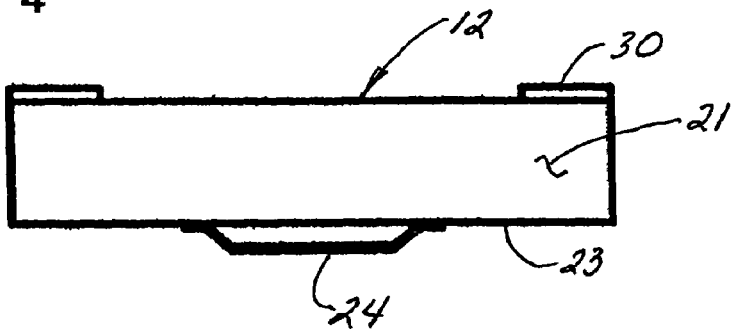
FIG. 4 is a top plan view of FIG. 3.

Referring now to the drawings, and firstly to FIG. 1, the preferred embodiment of the invention is shown in exploded perspective fashion generally at numeral 10. The apparatus 10 includes an outer enclosure 12, an inner document frame 14, a front document enclosure 16 and an upright support member 18.

Figure 6:
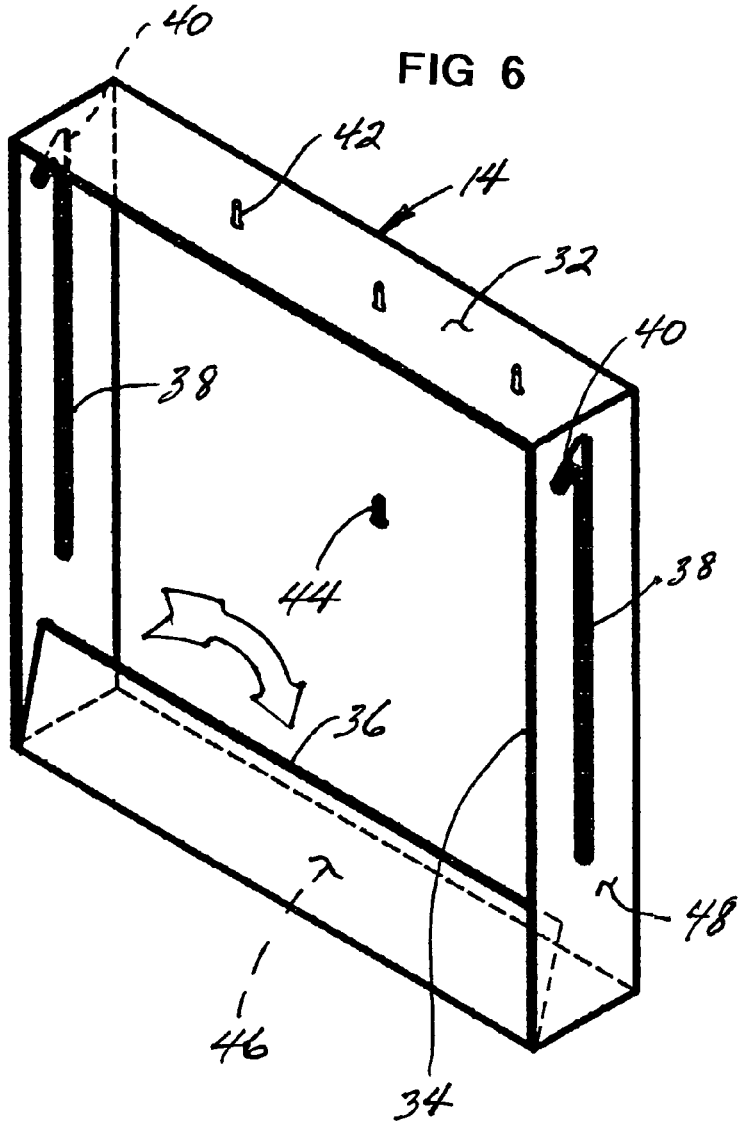
FIG. 6 is a perspective view of the inner document frame of FIG. 1.

Referring additionally to FIGS. 2 to 5, the outer enclosure 12, formed of preferably molded thin wall plastic material, but also alternately formed either in fabricated fashion or in blow mold fashion. The outer enclosure 12 includes a generally rectangular front panel 23, a back panel 28, preferably open in the central portion thereof as shown, whose purpose will be described herebelow, two spaced side panels 20, each of which include connectors 26, and a top panel 21, all of which are formed into a single weather resistant unit having an open bottom 22. A lifting handle 24 attached to the front panel 23 is also provided. The lower margin 30 of the back panel 28 is flared outwardly to facilitate holding the outer enclosure 12 in an upwardly open position with respect to the inner document frame 14 described herebelow. The inner frame 14 best seen in FIGS. 6, 8, 9 and 10 also is molded or fabricated in plastic in a fashion similar to that of the outer enclosure 12 and includes generally rectangular top, side and back panels 32, 48 and 49, respectively, and a bottom panel 45 all formed as a generally rectangular single unit. The front surface 34 is generally open except with respect to a lower document retaining panel 36 which upwardly extends diagonally inwardly a short distance from the front margin of bottom panel 45 so as to form a trough 46 for retaining documents placed therein in the direction of the arrow in FIG. 6.

Figure 15:
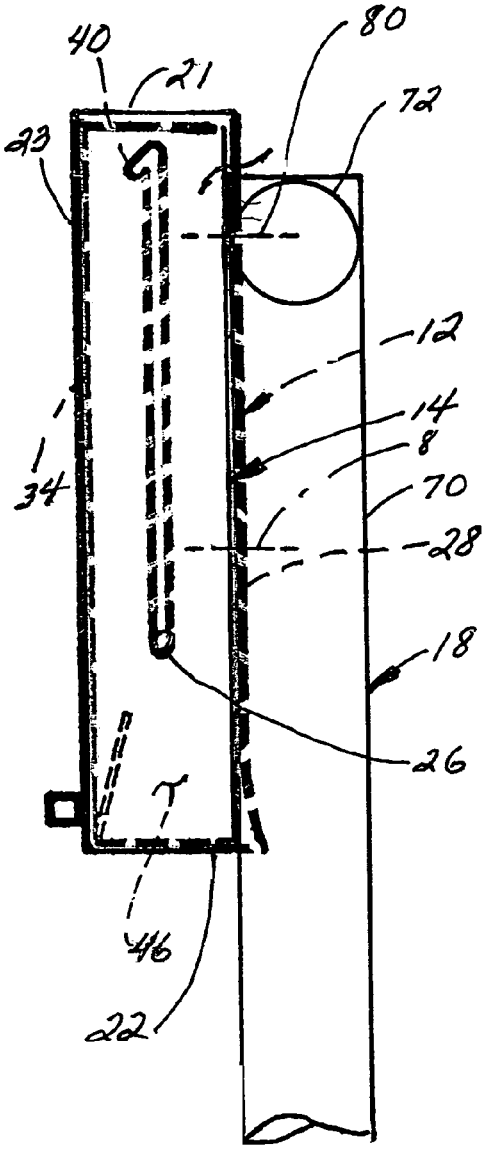
FIG. 15 is a side elevation partially broken view of the inner document frame and outer enclosure in its closed position shown attached to the upright support member of FIG. 1.
Figure 16:
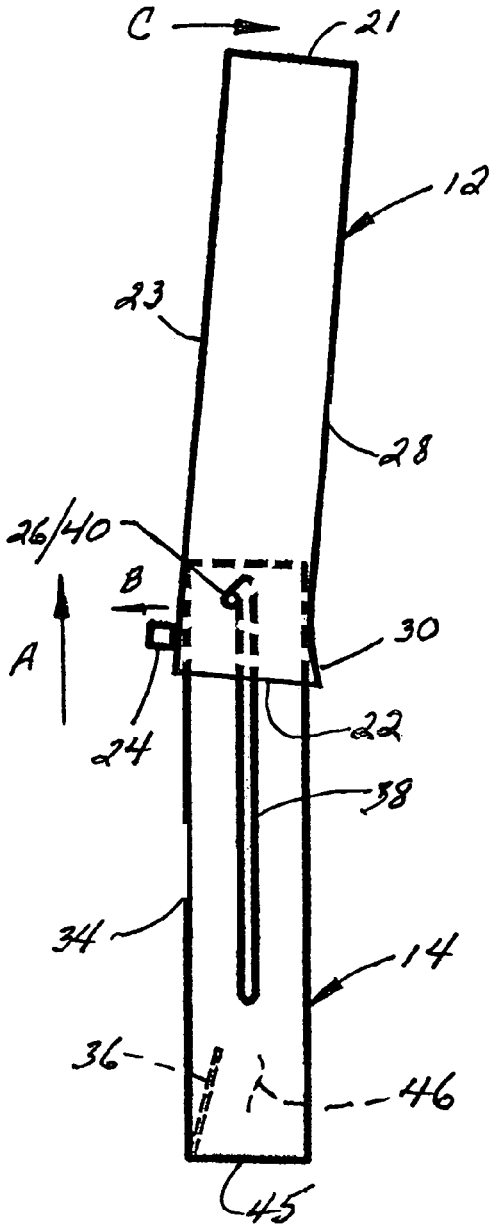
FIG. 16 is a side elevation view showing the outer enclosure in an open upward position with respect to the inner document frame.

As best seen in FIGS. 15 and 16, the outer enclosure 12 is sized to slidably fit over substantially all of the inner document frame 14. In its downwardly or closed position, the outer enclosure 12 thus renders the interior of the inner document frame 14, and trough 46, along with any documents placed therein, to be substantially weather tight or weather resistant. Slidable engagement of the outer enclosure 12 is facilitated and guided by connectors 26 which are connected into each side 20 of the outer enclosure 12. These connectors 26 slidably engage within a corresponding narrow elongated slot 38 each having a hook detent 40 at an upper end thereto. By this arrangement, the outer enclosure 12 may be slidably moved upwardly in the direction of arrow A, and pulled forwardly in the direction of arrow B facilitated by handle 24, into the open position shown in FIG. 16. At the same time, the upper end of the outer enclosure 12 moves rearwardly in the direction of arrow C facilitated for clearance by the flared configuration 30 of the back panel 28 into the upwardly releasably locked orientation shown in FIG. 16 wherein pins 26 are engaged into detent 40.

Referring now to FIGS. 11 to 14, an optional but preferred front document enclosure 16 is there shown. This front document enclosure 16 is generally rectilinear in overall shape defining a weather resistant interior volume 54 for receiving plans, blueprints, documents and material separate from those intended to be stored within trough 46 as previously described. This front document enclosure 16 includes front, back, side and bottom panels 50, 68, 62 and 64, respectively, all of which are sealingly connected and formed as a unit of plastic material either in molded or fabricated form as previously described. A flanged lid 56 is hingedly connected along pivot line 58 so that, when in a closed configuration, the interior volume 54 and the contents placed therein are substantially weather resistant. L-shaped brackets 60 attached to the side panel 62 provide mounting apertures 66 for fastener connection of the front document enclosure onto the front panel 23 of the outer enclosure 12 as seen in FIG. 1.

Referring now particularly to FIGS. 1 and 15, the preferred support member 18 includes an elongated upright stanchion 70 having a lower pointed end 78 and cross members 74 disposed adjacent thereto having ground engaging spikes 76 downwardly positioned at each end of the members 74. Disposed at the upper end is a transversely oriented cross bar 72 having anchors 80 connected thereto and laterally extending therefrom. An additional anchor 82 is provided in spaced relationship anchored into the stanchion 70. As best seen in FIG. 8, the back panel 49 of the inner frame 14 includes anchor receiving slots 42 and 44 having an enlarged lower end and narrowed upper slots which matably align with anchors 80 and 82, respectively.

Figure 3:
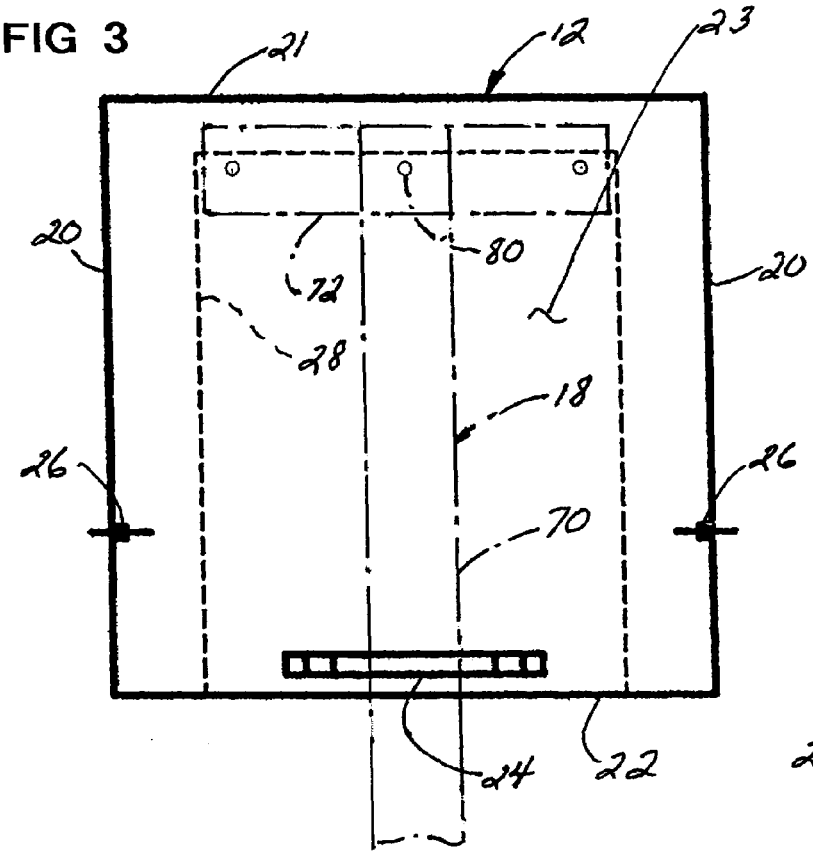
FIG. 3 is a front elevation view of FIG. 2.
Figure 5:
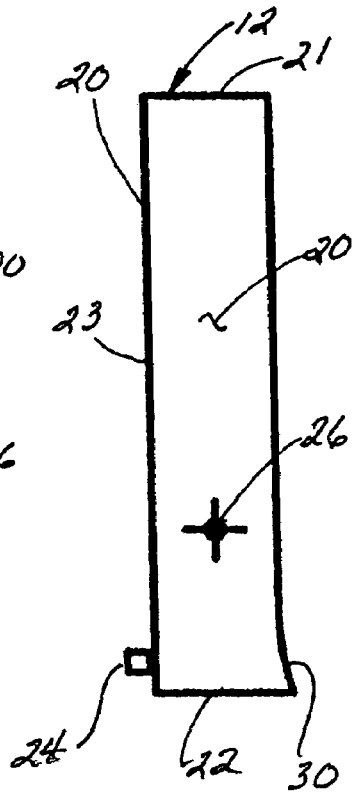
FIG. 5 is a side elevation view of FIG. 3.

Referring again to FIGS. 1, 2, 3 and 15, to provide convenient clearance for the outer enclosure 12 to slidably move as previously described in its upward and downward positions with respect to the inner document frame 14, a substantial portion of the central area of the back panel 28 has been removed as also seen in FIGS. 1, 2 and 3. The size of the open portion of the back panel 28 is such as best seen in FIG. 3 so as to provide clearance for the width of the cross bar 72 and the anchors 80 attached thereto.

Figure 7:
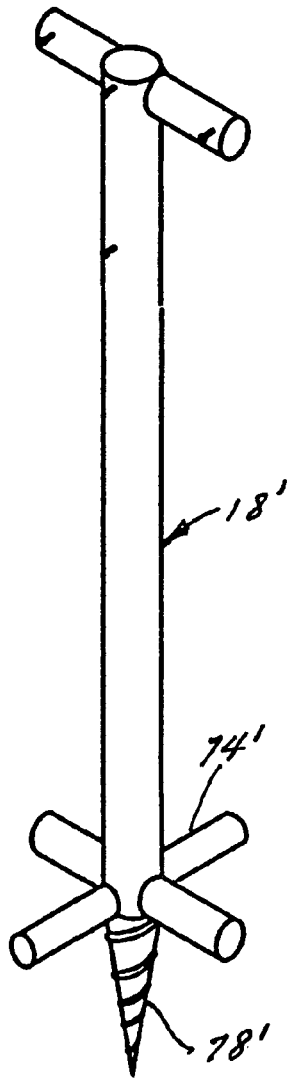
FIG. 7 is a perspective view of an alternate embodiment of the T-shaped support member of FIG. 1.
Figure 11:
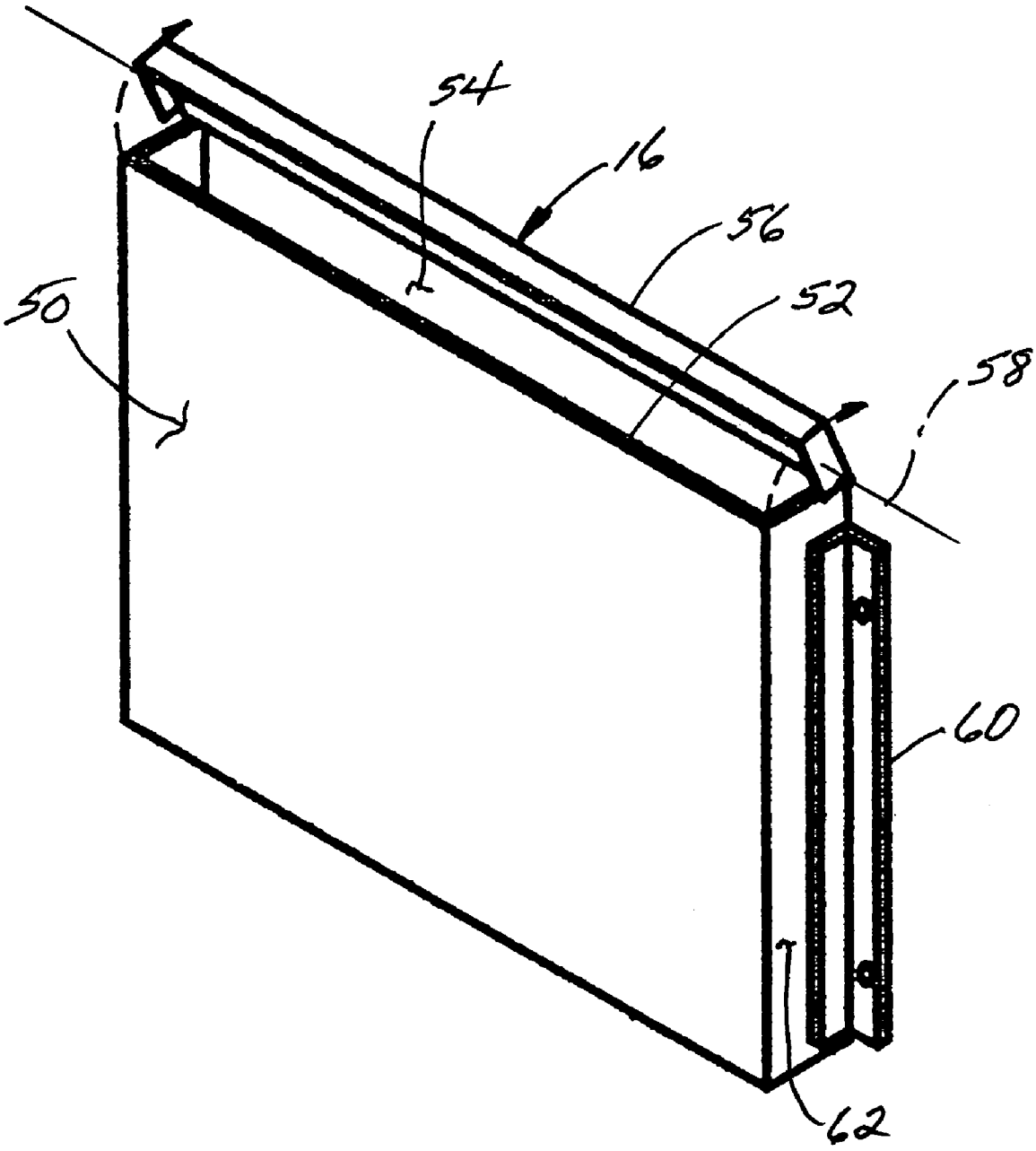
FIG. 11 is a perspective view of the front document enclosure of FIG. 1.
Figure 13:
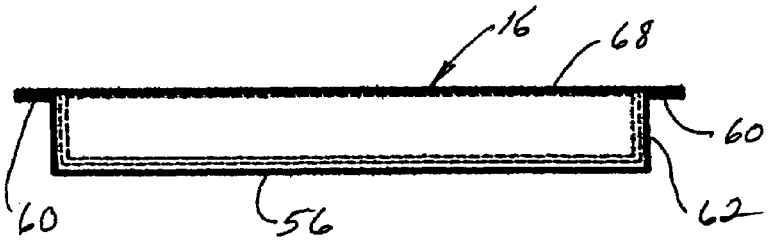
FIG. 13 is a top plan view of FIG. 12.
Figure 12:
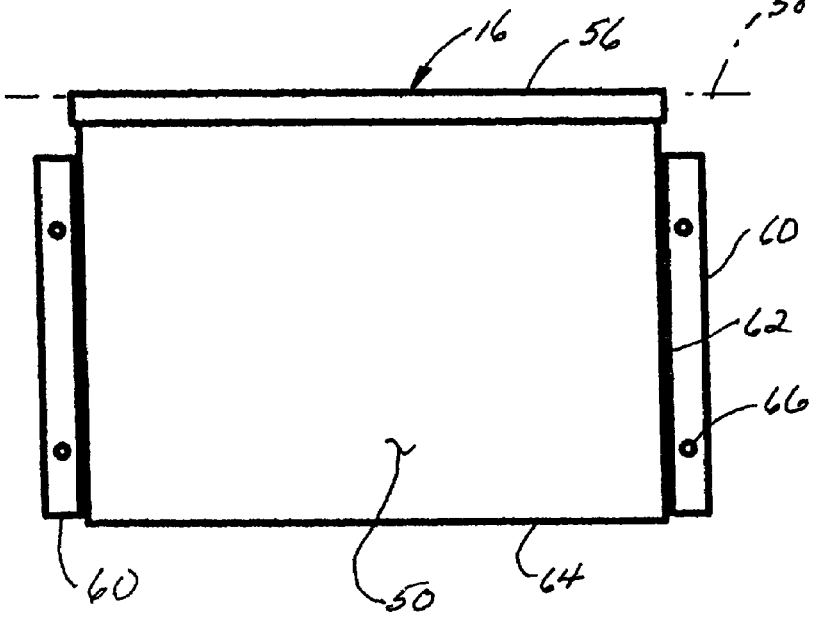
FIG. 12 is a front elevation view of FIG. 11.
Figure 14:
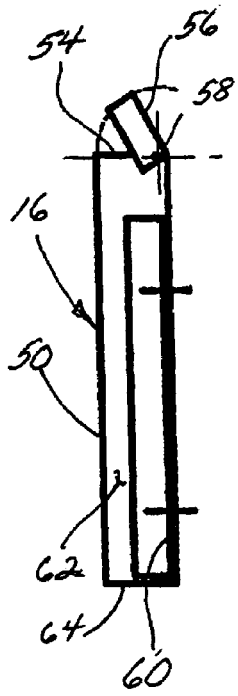
FIG. 14 is a side elevation view of FIG. 12.

Referring lastly to FIG. 7, an alternate support member 18' is there shown differing only from 18 in FIG. 1 with the deletion of spikes 76 and the addition of a spiral ground penetrating groove 78'.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A weather resistant construction site document storage apparatus comprising:

an elongated outer enclosure having a front panel, a back panel, two spaced side panels and a top panel, all of which are formed into a single weather-sealed unit having an open bottom thereof;

an elongated inner document frame having a top panel, two spaced side panels, a back panel and a bottom panel, all of which are formed into a single unit, and a document retaining panel connected to, and upwardly extending from, said bottom panel to define a trough, a remainder of a front surface of said inner frame being substantially open for document placement into, and removal from, said trough;

said outer enclosure sized for close upward and downward sliding engagement over substantially all of said inner frame to cover said open front surface and to weather protect documents placed into said trough;

an elongated slidable connector positioned between said side panels of said outer enclosure and said inner frame allowing said outer enciosure to be slidably lifted upwardly with respect to said inner frame but not removable therefrom whereby access is provided for document placement and removal from said trough when said outer enclosure is in an upward position with respect to said inner frame.

2. A weather resistant construction site document storage apparatus as set forth in claim 1, further comprising:

a weather resistant front document enclosure connected to a front surface of said front panel of said outer enclosure and having a weather resistant openable top lid for placing documents into and removal from an interior of said front document enclosure, said interior being weather resistant when said top lid is closed.

3. A weather resistant construction site document storage apparatus as set forth in claim 1, wherein:

a lower margin of said back panel of said outer enclosure is flared rearwardly and said slidable connector includes a detent at an upper end thereof wherein said outer enclosure may be tipped rearwardly at an upper end thereof to releasably lock said outer enclosure in an upward position.

4. A weather resistant construction site document storage apparatus as set forth in claim 1, further comprising:

an elongated T-shaped support member having an elongated upright stanchion and a cross bar connected at an upper end of said stanchion and having another anchor members connected thereto;

said back panel of said inner frame including slots for receiving said anchor members and releasably attaching said inner frame to said support member.

5. A weather resistant construction site document storage apparatus as set forth in claim 4, wherein:

a substantial central portion of said back panel of said outer enclosure is open for providing clearance for attachment of said support member to said back panel of said inner frame.

6. A weather resistant construction site document storage apparatus comprising:

an elongated outer enclosure having generally rectangular front, back, side and top panels, all of which are formed into a single weather-sealed unit having an open bottom thereof;

an elongated inner document frame having generally rectangular top, side bottom and back panels, all of which are formed into a single unit, and a document retaining panel connected to, and upwardly extending from, said bottom panel to define a trough, a remainder of a front surface of said inner frame being substantially open to place documents into, and remove them from, said trough;

said outer enclosure sized for close upward and downward sliding engagement over substantially all of said inner frame to cover said open front surface and to weather protect documents placed into said trough;

a slidable connector positioned between said side panels of said outer enclosure and said inner frame allowing said outer enclosure to be slidably lifted upwardly with respect to said inner frame but not removable therefrom whereby access is provided for document placement and removal from said trough;

said back panel of said inner frame adapted for connection to an upright support member.

7. A weather resistant construction site document storage apparatus as set forth in claim 6, further comprising:

a weather resistant front document enclosure connected to a front surface of said front panel of said outer enclosure and having a weather resistant openable top lid for placing documents into and removal from an interior of said front document enclosure, said interior being weather resistant when said top lid is dosed.

8. A weather resistant construction site document storage apparatus as set forth in claim 6, wherein:

a lower margin of said back panel of said outer enclosure is flared rearwardly and said slidable connector includes a detent at an upper end thereof whereby said outer enclosure may be tipped rearwardly at an upper end thereof to releasably lock said outer enclosure in an upward position.

9. A weather resistant construction site document storage apparatus as set forth in claim 6, wherein:

said upright support member includes an elongated T-shaped member having an elongated upright stanchion and a cross bar connected at an upper end of said stanchion and having another anchor members connected thereto;

said back panel of said inner frame including slots for receiving said anchor members and releasably attaching said inner frame to said support member.

10. A weather resistant construction site document storage apparatus as set forth in claim 9, wherein:

a substantial central portion of said back panel of said outer enclosure is open for providing clearance for attachment of said support member to said back panel of said inner frame.

* * * * *